US009784097B2

(12) United States Patent
Dugas

(10) Patent No.: US 9,784,097 B2
(45) Date of Patent: Oct. 10, 2017

(54) COMPRESSED TELEMETRY FOR TIME SERIES DOWNHOLE DATA USING VARIABLE SCALING AND GROUPED WORDS

(71) Applicant: Bryan C. Dugas, Breaux Bridge, LA (US)

(72) Inventor: Bryan C. Dugas, Breaux Bridge, LA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 95 days.

(21) Appl. No.: 14/672,850

(22) Filed: Mar. 30, 2015

(65) Prior Publication Data

US 2016/0290128 A1 Oct. 6, 2016

(51) Int. Cl.

| | |
|---|---|
| ***G01V 1/40*** | (2006.01) |
| ***H03M 7/00*** | (2006.01) |
| ***E21B 47/18*** | (2012.01) |

(52) U.S. Cl.

CPC ..... *E21B 47/18* (2013.01); *E21B 47/182* (2013.01)

(58) Field of Classification Search

CPC combination set(s) only.
See application file for complete search history.

(56) References Cited

U.S. PATENT DOCUMENTS

| | | | |
|---|---|---|---|
| 4,513,403 | A | 4/1985 | Troy |
| 4,908,804 | A | 3/1990 | Rorden |
| 5,157,392 | A | 10/1992 | Zimmer |
| 5,444,487 | A | 8/1995 | Kondo et al. |
| 5,812,086 | A | 9/1998 | Bertiger et al. |

(Continued)

FOREIGN PATENT DOCUMENTS

| | | | |
|---|---|---|---|
| WO | 2014031499 | A1 | 2/2014 |
| WO | 2014093735 | A1 | 6/2014 |

OTHER PUBLICATIONS

Notification of Transmittal of the International Search Report and the Written Opinion of the International Searching Authority, or the Declaration; PCT/US16/024647; Mailing Date Jul. 4, 2016, 15 pages.

(Continued)

*Primary Examiner* — Brian Zimmerman
*Assistant Examiner* — Cal Eustaquio
(74) *Attorney, Agent, or Firm* — Cantor Colburn LLP

(57) ABSTRACT

A method for transmitting data from a downhole location to a location at the surface of the earth includes determining a minimum value and a maximum value of M-samples of data values, determining a keycode for the M-samples of data values that provides an indication of the maximum and minimum values of the M-samples, and encoding the keycode and the data values into one or more encoded words. The one or more encoded words are then transmitted as an acoustic signal in drilling fluid by modulating a mud-pulser. The acoustic signal is received by a transducer uphole from the mud-pulser and converted into an electrical signal. The electrical signal is demodulated into a received encoded word, which is decompressed into the M-samples in accordance with the keycode. The M-samples are then received by a computer processing system disposed as the surface of the earth.

21 Claims, 5 Drawing Sheets

(56) References Cited

U.S. PATENT DOCUMENTS

| | | | | |
|---|---|---|---|---|
| 5,881,310 | A * | 3/1999 | Airhart | E21B 47/124 710/3 |
| 5,881,366 | A * | 3/1999 | Bodenmann | G06F 3/038 370/470 |
| 6,188,222 | B1 | 2/2001 | Seydoux et al. | |
| 6,229,454 | B1 | 5/2001 | Heikkila et al. | |
| 6,405,136 | B1 | 6/2002 | Li et al. | |
| 6,741,185 | B2 | 5/2004 | Shi et al. | |
| 6,753,791 | B2 | 6/2004 | Wei et al. | |
| 7,272,504 | B2 | 9/2007 | Akimov et al. | |
| 7,345,594 | B2 | 3/2008 | Huang et al. | |
| 7,805,247 | B2 | 9/2010 | Hsu et al. | |
| 8,044,821 | B2 | 10/2011 | Mehta | |
| 8,049,508 | B2 | 11/2011 | Gorek | |
| 8,305,243 | B2 | 11/2012 | Yu et al. | |
| 8,350,715 | B2 | 1/2013 | Shearer et al. | |
| 8,798,384 | B2 | 8/2014 | Le et al. | |
| 2007/0046431 | A1 * | 3/2007 | Chakraborty | G06K 19/0723 340/10.1 |
| 2007/0189119 | A1 * | 8/2007 | Klotz | E21B 47/18 367/83 |
| 2010/0049443 | A1 | 2/2010 | Mickael | |
| 2010/0195442 | A1 | 8/2010 | Reyes et al. | |
| 2010/0322308 | A1 | 12/2010 | Lee et al. | |
| 2011/0193704 | A1 * | 8/2011 | Harper | A61B 5/14532 340/573.1 |
| 2013/0110524 | A1 * | 5/2013 | Saleri | G06Q 50/06 705/1.1 |

OTHER PUBLICATIONS

Zhang, et al.; "A New Method for Real-Time LWD Data Compression"; 2009; Academy Publisher; 4 pages.

* cited by examiner

| | Pressure | KeyCode | Value | ENCODE | Description | Min | Max | Decoded |
|---|---|---|---|---|---|---|---|---|
| I | 7146.0 | 2 | 7146.0 | 36341 | Minimum | 7146.0 | 7148.0 | 7146.0 |
| | 7146.2 | 3 | 7147.7 | 52726 | Maximum | 7146.0 | 7148.0 | 7146.0 |
| | 7146.1 | 0 | | 116 | Compressed | 7146.0 | 7148.0 | 7146.0 |
| | 7146.9 | | | | | 7146.0 | 7148.0 | 7146.7 |
| | 7147.7 | | | | | 7146.0 | 7148.0 | 7148.0 |
| | 7146.4 | | | | | 7146.0 | 7148.0 | 7146.7 |
| | 7146.1 | | | | | 7146.0 | 7148.0 | 7146.0 |
| II | 7146.2 | 1 | -1/-1 | 24769 | DiffMinMax | 7145.0 | 7147.0 | 7146.3 |
| | 7145.4 | 0 | | 9974 | Compressed | 7145.0 | 7147.0 | 7145.7 |
| | 7146.0 | | | | | 7145.0 | 7147.0 | 7146.3 |
| | 7147.2 | | | | | 7145.0 | 7147.0 | 7147.0 |
| | 7146.7 | | | | | 7145.0 | 7147.0 | 7147.0 |
| | 7145.9 | | | | | 7145.0 | 7147.0 | 7145.7 |
| | 7146.0 | | | | | 7145.0 | 7147.0 | 7146.3 |
| III | 7146.0 | 0 | | 8651.0 | Compressed | 7145.0 | 7147.0 | 7146.3 |
| | 7145.3 | | | | | 7145.0 | 7147.0 | 7145.0 |
| | 7145.6 | | | | | 7145.0 | 7147.0 | 7145.7 |
| | 7147.1 | | | | | 7145.0 | 7147.0 | 7147.0 |
| | 7145.2 | | | | | 7145.0 | 7147.0 | 7145.0 |
| | 7146.5 | | | | | 7145.0 | 7147.0 | 7146.3 |

FIG. 4

COMPRESSED TELEMETRY FOR TIME SERIES DOWNHOLE DATA USING VARIABLE SCALING AND GROUPED WORDS

BACKGROUND

Boreholes are drilled into the earth for many applications such as hydrocarbon production, geothermal production, and carbon dioxide sequestration. In order to efficiently use expensive resources drilling the boreholes, it is important for analysts to acquire detailed information related to the geologic formations being drilled.

Various types of tools referred to as downhole tools may be conveyed through the boreholes to perform various types of measurements to provide the analysts with the needed information. In order to make efficient use of drilling time, some downhole tools may be disposed on a drill string drilling a borehole so that measurements can be performed while the borehole is being drilled. These types of measurements may be referred to a logging-while-drilling or measurement-while-drilling.

Once the measurements are obtained, they can be transmitted by telemetry to a receiver at the surface of the earth so that they can be made quickly available to the analysts without having to remove the drill string from the borehole. One type of telemetry for while-drilling applications is mud-pulse telemetry. In mud-pulse telemetry, downhole data is encoded into a digital format and transmitted by acoustic pulses in drilling mud filling the borehole or interior of the drill string. However, mud-pulse telemetry in general is limited to a fixed number of bits that may be transmitted to the surface per second. In that it is desired to transmit as much data to the surface as possible in the shortest amount of time, it would be appreciated in the drilling industry if method and apparatus were developed to increase the effective data transmission rate using available mud-pulse telemetry data rates.

BRIEF SUMMARY

Disclosed is a method for transmitting data from a downhole location to a location at the surface of the earth. The method includes: transmitting the data values to a downhole microprocessor-controlled buffer; querying the buffer for M-samples of the data values using an encoder that receives the M-samples; determining a minimum value and a maximum value of the M-samples using the encoder; determining a keycode for the M-samples that provides an indication of the maximum and minimum values of the M-samples using the encoder; encoding the keycode and the data values of the M-samples into one or more encoded words using the encoder; modulating a mud-pulser with a modulator to transmit the one or more encoded words as an acoustic signal in drilling fluid; receiving the acoustic signal uphole from the mud-pulser using a transducer that converts the acoustic signal into an electrical signal; demodulating the electrical signal using a demodulator into a received encoded word; decompressing the received encoded word into the M-samples in accordance with the keycode using a decoder; and receiving the M-samples from the decompressor using a computer processing system disposed at the surface of the earth.

Also disclosed is a method for transmitting data from a downhole location to a location at the surface of the earth. The method includes: performing downhole measurements using a downhole sensor that provides values of the measurements as data values; transmitting the data values to a downhole microprocessor-controlled buffer; querying the buffer for M-samples of the data values using an encoder that receives the M-samples; determining a minimum value and a maximum value of the M-samples using the encoder; determining a keycode for the M-samples that provides an indication of the maximum and minimum values of the M-samples using the encoder; encoding the keycode and the data values of the M-samples into one or more encoded words using the encoder, wherein encoding comprises using the following equation: CP[?]=INT(((VALUE[?]−MINIMUM)/(MAXIMUM−MINIMUM))*(2^N−1)) where N=a number of bits in an encoded word; modulating a mud-pulser with a modulator to transmit the one or more encoded words as an acoustic signal in drilling fluid; receiving the acoustic signal uphole from the mud-pulser using a transducer that converts the acoustic signal into an electrical signal; demodulating the electrical signal using a demodulator into a received encoded word; decompressing the received encoded word into the M-samples in accordance with the keycode using a decoder; receiving the M-samples from the decompressor using a computer processing system disposed at the surface of the earth; assigning a time to the M-samples at which they were received by the computer processing system; assigning a depth to the M-samples at which the M-samples were obtained; receiving current M-samples that immediately follow previous M-samples; calculating a difference between at least one of (a) a previous maximum value of the preceding M-samples and a present minimum value of the current M-samples and (b) a previous maximum value of the preceding M-samples and a present maximum value of the current M-samples; encoding the data values of the current M-samples with no indication of the previous minimum or maximum values changing if the difference is zero; encoding the data values of the current M-samples and the calculated difference between at least one of the minimum and maximum values if the calculated difference is a small change, wherein the small change is represented by a fewer number of bits than would be required to represent the actual minimum and maximum values of the M-samples; and encoding the data values of the current M-samples and the values of the current minimum value and the current maximum value if the calculated difference is a large change.

Further disclosed is an apparatus for transmitting data from a downhole location to a location at the surface of the earth. The apparatus includes: a downhole microprocessor-controlled buffer configured to receive transmitted data values; an encoder configured to (a) receive M-samples of the data values upon querying the buffer for the M-samples, (b) determine a minimum value and a maximum value of the M-samples, (c) determine a keycode for the M-samples that provides an indication of the maximum and minimum values of the M-samples using the encoder, and (d) encode the keycode and the data values of the M-samples into one or more encoded words using the encoder; a modulator coupled to a mud-pulser and configured to modulate the mud-pulser to transmit the one or more encoded words as an acoustic signal in drilling fluid; a transducer configured to receive the acoustic signal uphole from the mud-pulser and to convert the acoustic signal into an electrical signal; a demodulator configured to demodulate the electrical signal into an encoded word; a decoder configured to decompress the encoded word into the M-samples in accordance with the keycode; and a computer processing system disposed at the surface of the earth and configured to receive the M-samples from the decoder.

BRIEF DESCRIPTION OF THE DRAWINGS

The following descriptions should not be considered limiting in any way. With reference to the accompanying drawings, like elements are numbered alike:

FIG. 4 depicts aspects of transmitting data using different keycodes for encoding the data.

DETAILED DESCRIPTION

A detailed description of one or more embodiments of the disclosed apparatus and method presented herein by way of exemplification and not limitation with reference to the figures.

Disclosed are method and apparatus for transmitting data from a downhole tool disposed on a drill string to a receiver at the surface of the earth using mud-pulse telemetry. The method and apparatus call for transmitting a series of encoded words that are needed to compress a fixed set of time-series values of the same sensor measurement. Each encoded word may begin with a one, two or three bit keycode, which is used to identify the type of information that is encoded in the word. The rest of the encoded word is one or more scaled integer values, which are concatenated together to encode the information using a separate algorithm for each unique value of the keycode. In general, the keycodes used will be able to encode the Dynamic Range (e.g., Dynamic Minima, Dynamic Maxima), Relative Range (e.g., Delta Minima, Delta Maxima) and a fixed number of compressed words. In this manner, the transmitted data using a fixed number of bits can have better resolution using the Dynamic Range (e.g., Dynamic Minima, Dynamic Maxima) of the fixed set of data than if the same fixed number of bits had been used to transmit the same as individual values using a larger overall fixed range (i.e., Fixed Minima, Fixed Maxima). Because bandwidth (e.g., a number of bits/second) to transmit unnecessary data (i.e., bits to cover from zero to the minimum value and bits to cover above the maximum value) is not needed, more data can be transmitted using the same physical baud rate (bits/second) due to variable scaling of the data values in accordance with the minimum and maximum values transmitted in the encoded word. The data transfer rate may be further increased by not transmitting the maximum and minimum values with each group of data realizing that in certain well logging conditions the data values may not vary much or at all within the previously transmitted maximum and minimum values. Hence, the indicator of the maximum and minimum values of the data in the group need only be transmitted when the maximum and minimum values of the data values change.

Figure 1:
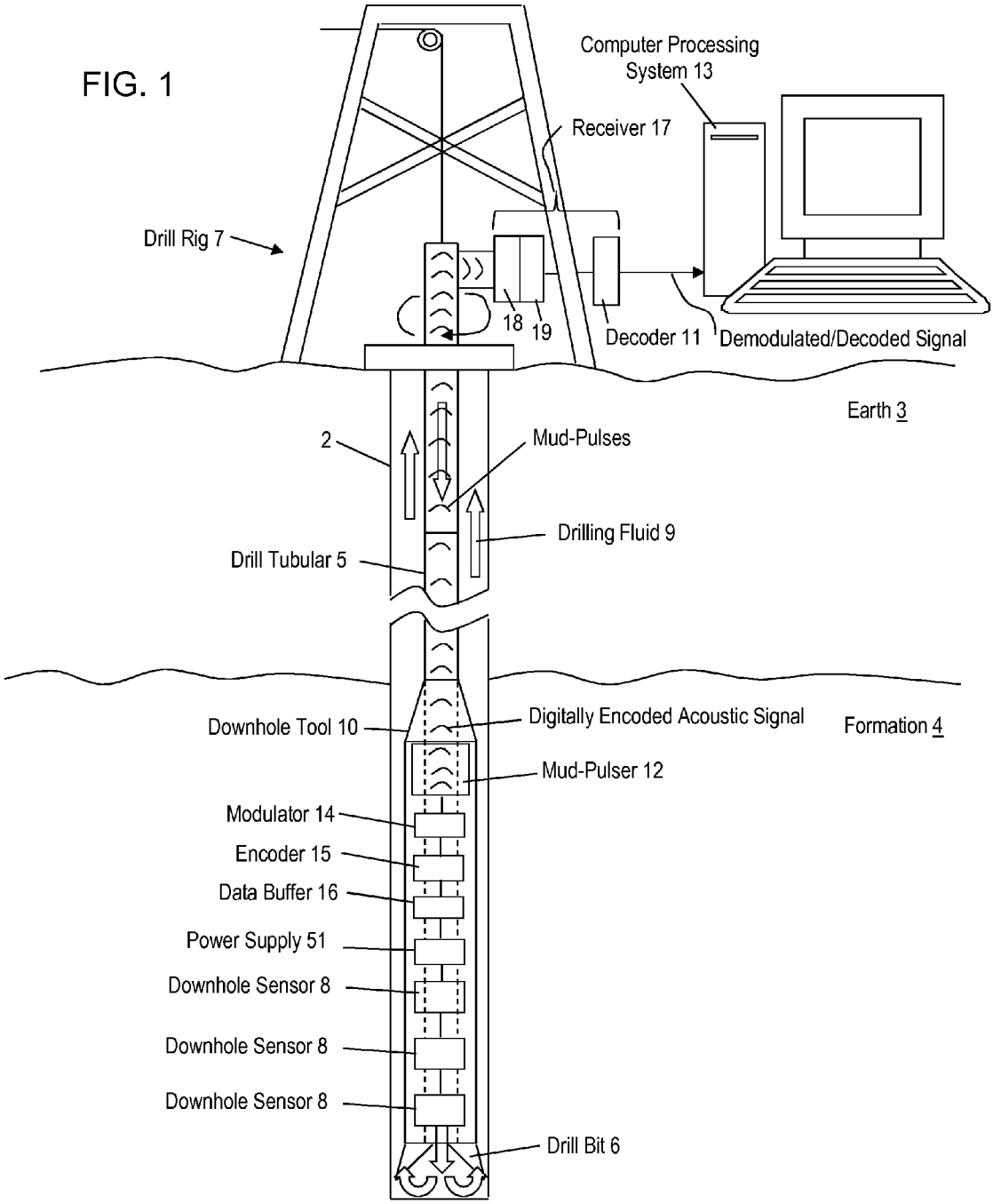
FIG. 1 illustrates a cross-sectional view of an embodiment of a downhole while-drilling tool disposed in a borehole penetrating the earth.

FIG. 1 illustrates a cross-sectional view of an embodiment of a downhole tool 10 disposed in a borehole 2 penetrating the earth 3, which includes an earth formation 4. The downhole tool 10 is conveyed through the borehole 2 by a drill tubular 5 such as jointed drill pipe or coiled tubing for example. A drill bit 6 is disposed at the distal end of the drill tubular 5. A drill rig 7 is configured to conduct drilling operations such as rotating the drill tubular 5 and thus the drill bit 6 in order to drill the borehole 2. In addition, the drill rig 7 is configured to pump drilling fluid 9, also referred to as drilling mud, through the drill tubular 5 in order to lubricate the drill bit 6 and flush cuttings from the borehole 2. The downhole tool 10 may include one or more various sensors 8 spaced along the borehole 2. Each sensor 8 may be configured to sense various downhole properties such a borehole property, a formation property or a tool property. Non-limiting examples of the sensor measurements include pressure, temperature, acceleration, density, porosity, acoustic, viscosity, compressibility, radiation, resistivity, nuclear magnetic resonance (NMR), and spectroscopy using optical transmissivity or reflectivity for example. Each sensor has a position in the drill string called a "sensor offset" which is used to assign depth. A time versus depth relationship is kept for the drill bit and the position of each sensor can be computed from the time of the measurement, the depth of the bit and the "sensor offset" of the measurement.

Data collected downhole or sensed by the sensor 8 (i.e., measurement values or data values) is received by a data buffer 16 for temporarily storing measurements that cannot be immediately transmitted to a receiver 17 because of limited telemetry bandwidth. The buffer 16 may be implemented by a micro-processor controlled device to operate on a first-in first-out (FIFO) basis in response to a query. An encoder 15, which may be micro-processor controlled, is configured to receive data from the buffer 16 in response to a query from the encoder 15. In one or more embodiments, the data is a number (M) of measurement values, herein referred to as M-samples. The encoder 15 is also configured to (a) determine a minimum value and a maximum value of the M-samples, (b) attach a keycode to the M-samples that provides an indication of the maximum and minimum values of the M-samples, and (c) compress the keycode and the data values of the M-samples into one group of words (such as one series of bits). Compressing the data values of the M-samples includes scaling the data values based on the difference between the maximum and minimum values of the M-samples into smaller number of N-bits for each sample where N is evenly divided into M. The M N-bit values are then concatenated together and a compressed keycode is appended to the beginning of the M N-bit values.

A modulator 14 receives the one group of words and is configured to modulate the one group of words in accordance with a digital modulation scheme such as phase shift keying. Phase shift keying conveys data by changing, or modulating, the phase of a reference signal (the carrier wave). The modulation is applied to a mud-pulser 12, which is configured to transmit the modulation of the one group of words as an acoustic signal in drilling fluid 9. The mud-pulser 12 is configured to momentarily interrupt the flow of the drilling fluid 9 thereby generating an acoustic pulse that travels to the surface of the borehole 2. Non-limiting embodiments of the mud-pulser 12 include a plunger-type valve and a shear-type valve. In that mud-pulsers are known in the art, they are not discussed in further detail. A power supply 51 such as a battery or mud turbine powered generator for example supplies power for operation of the mud-pulser 12. At the surface, the acoustic signal is received by the receiver 17.

The receiver 17 at the surface includes a transducer 18, a demodulator 19, and a decoder 11. The transducer 18 is configured to convert the received acoustic signal into an electrical signal that can be processed. The demodulator 19 is configured to demodulate the electrical signal received by the transducer 18 in accordance with the selected digital modulation scheme to provide an encoded word that includes the downhole data values. The encoded word is then decoded by a decoder 11, which is configured to decompress the encoded word into the M-samples in accordance with the keycode prefix at the beginning of each encoded word. Decompressing the encoded word relates to unscaling the encoded data values based upon the difference between the maximum and minimum values of the M-samples. The decoder 11 provides a bit stream that represents the downhole data values. A surface computer processing system 13 is configured to receive the bit stream in order to extract the transmitted downhole data values and put this data in a format that can be displayed to be used by a display or printer as non-limiting examples and/or stored in memory or a storage medium for future use. It can be appreciated that the functions of the demodulator and the decoder may be implemented by the computer processing system 13.

Figure 2A:
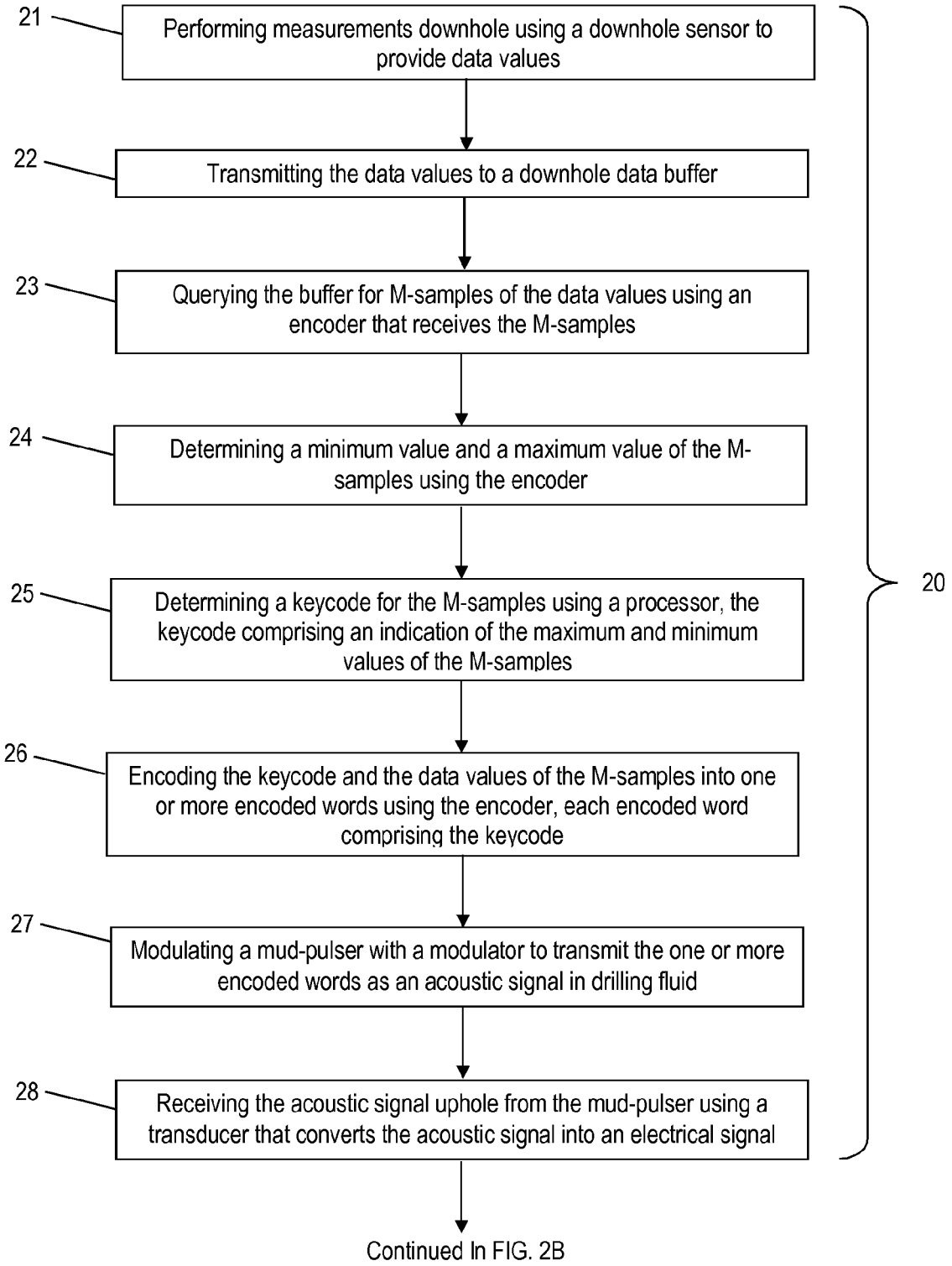
FIGS. 2A and 2B, collectively referred to as FIG. 2, are a flow chart for a method for transmitting data from a downhole location on a drill string to a location at the surface of the earth.
Figure 2B:
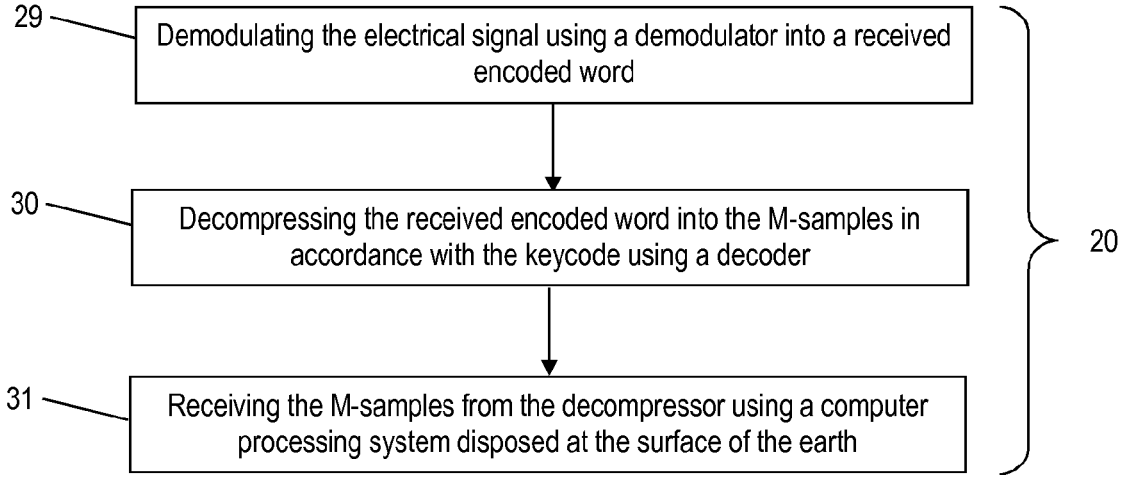

FIG. 2 is a flow chart for a simplified method 20 for transmitting data from a downhole location to a location at the surface of the earth. Block 21 calls for performing measurements downhole using a downhole sensor. The measurements provide values of the measurements, which may in general be referred to as data values. Block 22 calls for transmitting the data values to a downhole data buffer. Block 23 calls for querying (i.e., requesting the buffer to send) the buffer for M-samples of the data values using an encoder that receives the M-samples. Block 24 calls for determining a minimum value and a maximum value of the M-samples using the encoder. Block 25 calls for determining a keycode for the M-samples using a processor, where the keycode provides an indication of the maximum and minimum values of the M-samples. Block 25 may also include comparing previously computed minimum and maximum values with current minimum and maximum values and determining whether to send the minimum and maximum values, the relative change in the minimum and maximum values, or no change at all to the minimum and maximum values. Block 25 may include comparing the new Minimum and Maximum against the previous Minimum and Maximum and determining the appropriate number of encoded words that will be needed to encode the M-Samples. For example: Large Change in Min/Max=MINIMUM+MAXIMUM+COMPRESSED DATA (Three words); Small Change in Min/Max=DIFFMINMAX+COMPRESSED DATA (Two Words); No Change in Min/Max=COMPRESSED DATA (One Word, max compression).

Figure 3:
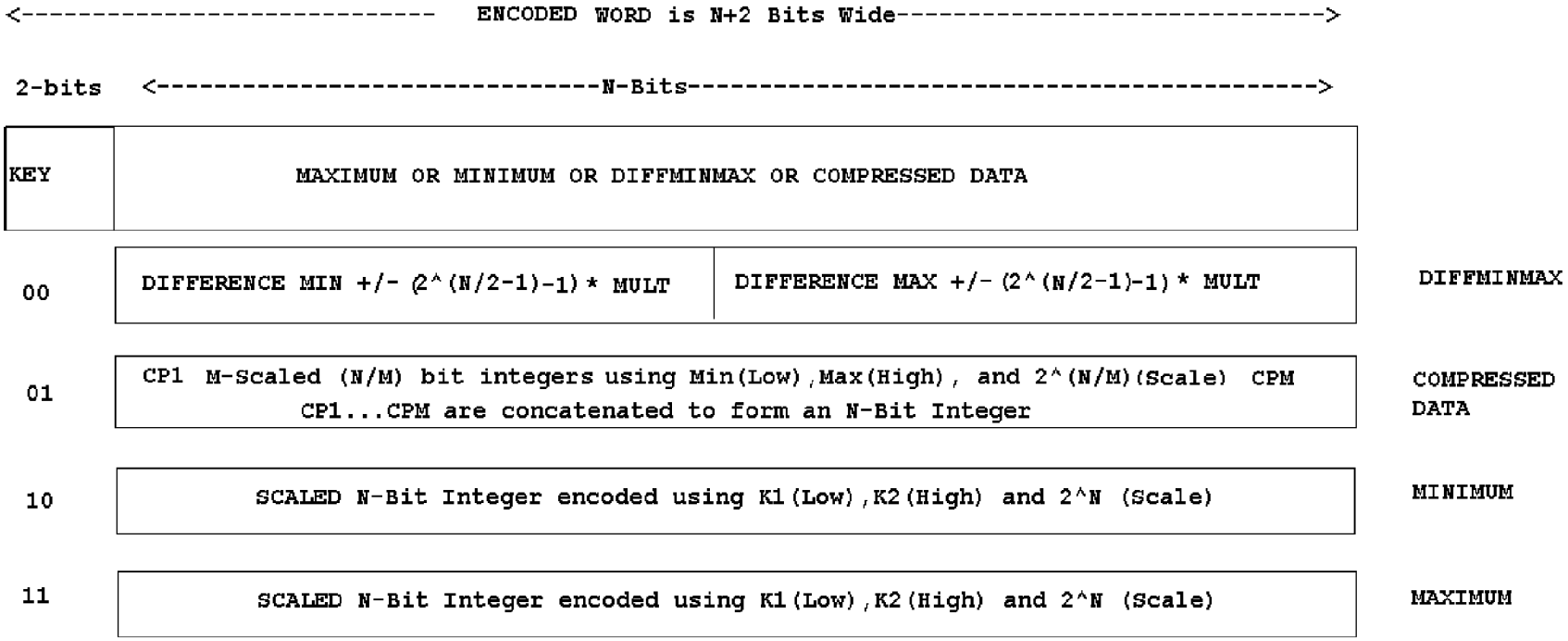
FIG. 3 depicts aspects of one embodiment of encoded words for transmission by mud-pulse telemetry.

Block 26 calls for encoding the keycode and the data values of the M-samples into one or more encoded words such as a group of words (or one series of bits) using the encoder. For example, the M-Samples may be encoded into 1, 2 or 3 Encoded Words depending on the change in Minimum and Maximum (1 word=No Change in Min/Max, 2 words=Small Change in Min/Max, 3 words=Large Change in Min/Max). FIG. 3 illustrates one embodiment of the one to three encoded words used to encode the M-samples as one group of words. In this embodiment, two bits are used for the keycode and N-bits are used to compress the M-samples of data, provide the differential minimum and maximum, provide the minimum value of the M-samples, or provide the maximum value of the M-samples depending on the keycode. In alternative embodiments, one or more than two bits can be used for the keycode. The MULT is a predetermined value that sets the limit of the small differential change that can be encoded. If N=14, then the small difference that can be encoded is a change of +/−63 times the MULT. The MULT is generally the resolution of the N-Bit word divided by 2 to a power. Each power of 2 above zero improves the resolution by 1 bit (0=14 bit, 1=15 bit, 2=16 bit, etc.) but reduces the small difference that can be encoded in the DIFFMINMAX word. Several sensor measurements can be multiplexed in the telemetry and each can have a unique ENCODED WORD with its own WORD NAME, K1 (Low), K2 (High), N, Scale (2^N), M, KEYBITS and MULT.

Referring back to FIG. 2, Block 27 calls for modulating a mud-pulser with a modulator to transmit each encoded word as an acoustic signal in drilling fluid. Block 28 calls for receiving the acoustic signal uphole from the mud-pulser using a transducer that converts the acoustic signal into an electrical signal. The term "uphole" relates to being closer to the surface via the borehole. Block 29 calls for demodulating the electrical signal using a demodulator into a received encoded word. Block 30 calls for decompressing the one or more received encoded words into the M-samples in accordance with the keycode using a decoder. Decompressing may also include adjusting the received M-samples in accordance with the minimum and maximum values and unscaling the M-samples when an encoded word includes compressed data. In one or more embodiments, the decompressed M-samples are digital data values that are measured from zero such as the data values provided by the downhole sensor. Block 31 calls for receiving the M-samples from the decompressor using a computer processing system disposed at the surface of the earth. Block 31 may also include assigning a time to the M-samples at which they were received and/or assigning a depth at which the M-samples were obtained. Depth information may be provided by surface equipment (not shown) that monitors the depth of the borehole. Block 31 may also include storing the M-samples (i.e., the values of each of the M-samples) in memory or a storage medium and/or displaying values of each of the M-samples to a user using a user interface such as a display or a printer.

As discussed above, the downhole tool 10 can include a plurality of sensors 8. The method 20 can accommodate the plurality of sensors 8 by assigning a unique name sensor to each encoded word that identifies the sensor providing the data.

Further aspects of embedding the keycode in an encoded word are now discussed. It can be appreciated by one ordinary skill in the art that the keycode may be part of each encoded word. Each of the M-Samples is a series of integer numbers (encoded words) which use either 1, 2 or 3 words, for example, to encode both the minimum, maximum and compressed M-samples of data. An example of all three types is illustrate in FIG. 4 where Group I is the initial transmission where both Min, Max and compressed data must be fully encoded, Group II is a small change (−1,−1) in min/max and compressed data, and Group III is no change (0,0) in min/max and only compressed data is encoded. The numbers in the Encoded WORD column (36341, 52726, 116, 24769, 9974 and 8651) encode 21 pressure values in 6 WORDS/12 bytes or 96 bits with a resolution of <1 psi (the four Keycodes are embedded in each number). The encoding in one or more embodiments is performed in accordance with an algorithm discussed further below. The bit pattern for the first 6 words is (1000110111110101, 1100110111110110, 0000000001110100, 0110000011000001, 0010011011110110, 0010000111001011).

Further aspects of the downhole encoder 15 are now discussed. When the encoder receives the M-samples, the values of the M-Samples (VALUE[1 . . . M]) are measured and the minimum and maximum values are determined. The minimum and maximum values are compared against the current minimum and maximum values. If there is a small change (i.e., the corresponding difference is small or below a threshold value), then the difference between the current and immediate previous minimum values and/or the difference between the current and immediate previous maximum values are sent as an encoded word with one keycode and the M-samples are sent as a second encoded word with a different keycode. If there is a large change (i.e., the corresponding difference is large or exceeds a threshold value), then an encoded word for the maximum, an encoded word for the minimum, and an encoded for the M-samples are transmitted as one series of bits. One factor in determining a threshold value used to quantify if a change in minimum and/or maximum values is small or large is the size of the word (i.e., small word) needed to encode a small difference versus the size of the word (i.e., large word that is larger than the small word) needed to transmit the actual minimum and maximum values. Hence, if two small words can be sent to quantify the difference(s), then the data can be transmitted faster than if a large word was needed to fully encode the minimum and maximum. If there was no minimum and/or maximum value previously sent, then the minimum and maximum values must be encoded as two encoded words with the M-samples encoded as a third encoded word. A large change (e.g., a hardcoded fixed value) in either the Minimum or Maximum is a change that cannot be encoded using half of the encoded word bits. Conversely, a small change is a change that can be encoded using half of the encoded word bits necessary to encode the actual minimum and maximum values. Alternatively, in one or more embodiments, a small change is any change that can be encoded using a fewer number of bits than that needed to encode the actual minimum and maximum values.

Using the current minimum and maximum values, the encoder calculates M-compressed N-bit data words—CP[?]=INT(((VALUE[?]−MINIMUM)/(MAXIMUM−MINIMUM))*(2ˆN−1)) and encodes the compressed words by concatenating all the N-bit data words together using COMPRESSKEY+CP[1] . . . CP[M] into a single encoded word.

Further aspects of the surface decoder 11 are now discussed. The decoder receives an encoded word from the demodulator and separates the encoded word into keycode and data. IF KEYCODE=MAXKEY, then unscale data into maximum. IF KEYCODE=MINKEY, then unscale data into minimum. IF KEYCODE=MINMAXKEY, then convert data into DIFFMIN and DIFFMAX where $MINIMUM_{CURRENT}=MINIMUM_{PREVIOUS}+DIFFMIN$ and $MAXIMUM_{CURRENT}=MAXIMUM_{PREVIOUS}+DIFFMAX$. IF KEYCODE=COMPRESSKEY, then parse data into M N-bit values (CP[1] . . . CP[M]) FOR I=1 TO M where VALUE[I]=(CP[I]/(2ˆN−1))*(MAXIMUM−MINIMUM)+MINIMUM.

The decoder and/or the surface computer processing system may assign a time when each VALUE[I] was received, assign a depth at which each VALUE[I] was obtained, and store the time, depth and corresponding VALUE[I].

In support of the teachings herein, various analysis components may be used, including a digital and/or an analog system. For example, the downhole sensor 8, the downhole tool 10, the mud-pulser 12, the data buffer 16, the modulator 14, the encoder 15, the surface computer processing system 13, the receiver 17, the transducer 18, the demodulator 19, and/or the decoder 11, may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The term "coupled" relates to one component being coupled to another component either directly or indirectly through an intermediate component.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for transmitting data from a downhole location to a location at the surface of the earth, the method comprising:

transmitting the data values to a downhole microprocessor-controlled buffer;

querying the buffer for M-samples of the data values using an encoder that receives the M-samples;

determining a minimum value and a maximum value of the M-samples using the encoder;

determining a keycode for the M-samples that provides an indication of the maximum and minimum values of the M-samples using the encoder;

compressing with the encoder the M-samples of the data values into M-compressed data words using the maximum and minimum values;

encoding the keycode and the M-compressed data words into one encoded word by concatenating the keycode and the M-compressed data words using the encoder;

modulating a mud-pulser with a modulator to transmit the one encoded word as an acoustic signal in drilling fluid;

receiving the acoustic signal uphole from the mud-pulser using a transducer that converts the acoustic signal into an electrical signal;

demodulating the electrical signal using a demodulator into a received encoded word;

decompressing the received encoded word into the M-samples in accordance with the keycode using a decoder; and receiving the M-samples from the decoder using a computer processing system disposed at the surface of the earth.

2. The method according to claim 1, wherein further comprising performing a downhole measurement using a downhole sensor that provides values of the measurements as the data values.

3. The method according to claim 1, further comprising assigning a time to the M-samples at which they were received by the computer processing system.

4. The method according to claim 1, further comprising assigning a depth to the M-samples at which the M-samples were obtained.

5. The method according to claim 1, further comprising storing values of the M-samples in memory or a storage medium.

6. The method according to claim 1, further comprising displaying values of each of the M-samples to a user using a user interface such as a display or a printer.

7. The method according to claim 1, further wherein the keycode comprises at least one of a maximum value of the M-samples and a minimum value of the M-samples.

8. The method according to claim 1, further comprising:

receiving current M-samples that immediately follow previous M-samples;

calculating a difference between at least one of (a) a previous minimum value of the preceding M-samples and a present minimum value of the current M-samples and (b) a previous maximum value of the preceding M-samples and a present maximum value of the current M-samples;

encoding the data values of the current M-samples with no indication of the previous minimum or maximum values changing if the difference is zero;

encoding the data values of the current M-samples and the calculated difference between at least one of the minimum and maximum values if the calculated difference is a small change, wherein the small change is represented by a fewer number of bits than would be required to represent the actual minimum and maximum values of the M-samples; and encoding the data values of the current M-samples and the values of the current minimum value and the current maximum value if the calculated difference is a large change.

9. The method according to claim 1, wherein the data values are transmitted by a plurality of sensors disposed at the downhole location, and the method further comprises labelling each encoded word with a label corresponding to the downhole sensor providing the data encoded in the word using the encoder.

10. The method according to claim 1, wherein the keycode is encoded using one, two or three bits.

11. The method according to claim 1, wherein compressing comprises using the following equation to calculate a compressed N-bit data word, CP[?], to be encoded for each of the M-samples of the data values:

$$CP[?]=\mathrm{INT}(((\mathrm{VALUE}[?]-\mathrm{MINIMUM})/(\mathrm{MAXIMUM}-\mathrm{MINIMUM}))*((2^{\wedge}N)-1))$$

where N=a number of bits in an encoded word, MINIMUM is the minimum value, MAXIMUM is the maximum value, and VALUE is the data value, identified by ?, for which the compressed N-bit data word is being calculated.

12. A method for transmitting data from a downhole location to a location at the surface of the earth, the method comprising:

performing downhole measurements using a downhole sensor that provides values of the measurements as data values;

transmitting the data values to a downhole microprocessor-controlled buffer;

querying the buffer for first M-samples of the data values using an encoder that receives the first M-samples;

determining a minimum value and a maximum value of the first M-samples using the encoder;

determining a keycode for the first M-samples that provides an indication of the maximum and minimum values of the first M-samples using the encoder;

compressing with the encoder the first M-samples of the data values into M-compressed data words using the maximum and minimum values;

encoding the keycode and the M-compressed data words into one encoded word by concatenating the keycode and the M-compressed data words using the encoder, and wherein compressing comprises using the following equation to calculate a compressed N-bit data word, CP[?], to be encoded for each of the first M-samples of the data values:

$$CP[?]=\mathrm{INT}(((\mathrm{VALUE}[?]-\mathrm{MINIMUM})/(\mathrm{MAXIMUM}-\mathrm{MINIMUM}))*((2^{\wedge}N)-1))$$

where N=a number of bits in an encoded word, MINIMUM is the minimum value of the first M-samples, MAXIMUM is the maximum value of the first M-samples, and VALUE is the data value, identified by ?, for which the compressed N-bit data word is being calculated;

modulating a mud-pulser with a modulator to transmit the one encoded word as an acoustic signal in drilling fluid;

receiving the acoustic signal uphole from the mud-pulser using a transducer that converts the acoustic signal into an electrical signal;

demodulating the electrical signal using a demodulator into a received encoded word;

decompressing the received encoded word into the first M-samples in accordance with the keycode using a decoder;

receiving the first M-samples from the decoder using a computer processing system disposed at the surface of the earth;

assigning a time to the first M-samples at which they were received by the computer processing system;

assigning a depth to the first M-samples at which the first M-samples were obtained;

receiving current second M-samples that immediately follow previous first M-samples;

calculating a difference between at least one of (a) a previous minimum value of the preceding first M-samples and a present minimum value of the current second M-samples and (b) a previous maximum value of the preceding first M-samples and a present maximum value of the current second M-samples;

encoding the data values of the current second M-samples with no indication of the previous minimum or maximum values changing if the difference is zero;

encoding the data values of the current second M-samples and the calculated difference between at least one of the minimum and maximum values if the calculated difference is a small change, wherein the small change is represented by a fewer number of bits than would be required to represent the actual minimum and maximum values of the second M-samples; and encoding the data values of the current second M-samples and the values of the current minimum value and the current maximum value if the calculated difference is a large change.

13. An apparatus for transmitting data from a downhole location to a location at the surface of the earth, the apparatus comprising:

a downhole microprocessor-controlled buffer configured to receive transmitted data values;

an encoder configured to (a) receive M-samples of the data values upon querying the buffer for the M-samples, (b) determine a minimum value and a maximum value of the M-samples, (c) determine a keycode for the M-samples that provides an indication of the maximum and minimum values of the M-samples using the encoder, (d) compress with the encoder the M-samples of the data values into M-compressed data words using the maximum and minimum values, and (e) encode the keycode and the M-compressed data words into one encoded word by concatenating the keycode and the M-compressed data words using the encoder;

a modulator coupled to a mud-pulser and configured to modulate the mud-pulser to transmit the one encoded word as an acoustic signal in drilling fluid;

a transducer configured to receive the acoustic signal uphole from the mud-pulser and to convert the acoustic signal into an electrical signal;

a demodulator configured to demodulate the electrical signal into an encoded word;

a decoder configured to decompress the encoded word into the M-samples in accordance with the keycode; and a computer processing system disposed at the surface of the earth and configured to receive the M-samples from the decoder.

14. The apparatus according to claim 13, further comprising a downhole sensor configured to perform a downhole measurement that provides values of the measurements as the data values.

15. The apparatus according to claim 14, wherein the downhole sensor comprises a plurality of downhole sensors, and the encoder is configured to label each encoded word with a label corresponding to the downhole sensor providing the data encoded in the word using the encoder.

16. The apparatus according to claim 13, wherein the computer processing system is configured to assign a time to the M-samples at which they were received by the computer processing system.

17. The apparatus according to claim 13, wherein the computer processing system is configured to assign a depth to the M-samples at which the M-samples were obtained.

18. The apparatus according to claim 13, wherein the encoder is further configured to:

receive current M-samples that immediately follow previous M-samples;

calculate a difference between at least one of (a) a previous minimum value of the preceding M-samples and a present minimum value of the current M-samples and (b) a previous maximum value of the preceding M-samples and a present maximum value of the current M-samples;

encode the data values of the current M-samples with no indication of the previous minimum or maximum values changing if the difference is zero;

encode the data values of the current M-samples and the calculated difference between at least one of the minimum and maximum values if the calculated difference is a small change, wherein the small change is represented by a fewer number of bits than would be required to represent the actual minimum and maximum values of the M-samples; and encode the data values of the current M-samples and the values of the current minimum value and the current maximum value if the calculated difference is a large change.

19. The apparatus according to claim 13, further comprising a user interface configured to display received data at the surface of the earth to a user.

20. The apparatus according to claim 13, further comprising a storage medium configured to store data received at the surface of the earth.

21. The apparatus according to claim 13, wherein the encoder is further configured to use the following equation to calculate a compressed N-bit data word, CP[?], to be encoded for each of the M-samples of the data values:

$$CP[?]=\mathrm{INT}(((\mathrm{VALUE}[?]-\mathrm{MINIMUM})/(\mathrm{MAXIMUM}-\mathrm{MINIMUM}))*((2\hat{}N)-1))$$

where N=a number of bits in each encoded word, MINIMUM is the minimum value, MAXIMUM is the maximum value, and VALUE is the data value, identified by ?, for which the compressed N-bit data word is being calculated.

* * * * *